United States Patent [19]

Blair

[11] Patent Number: 4,586,274

[45] Date of Patent: May 6, 1986

[54] ATHLETIC SHOE CLEATS FOR ARTIFICIAL TURF

[76] Inventor: Roy D. Blair, 124 Cypress St., Watertown, Mass. 02172

[21] Appl. No.: 619,775

[22] Filed: Jun. 11, 1984

[51] Int. Cl.[4] ..... A43B 13/26; A43C 13/04

[52] U.S. Cl. ..... 36/59 R; 36/67 A; 36/114

[58] Field of Search ..... 36/59 R, 59 B, 59 C, 36/67 R, 67 A, 114, 129, 32 R; D2/320, 321

[56] References Cited

U.S. PATENT DOCUMENTS

| | | | |
|---|---|---|---|
| 4,233,759 | 11/1980 | Bente et al. | 36/59 R |
| 4,327,503 | 5/1982 | Johnson | 36/59 C |
| 4,364,188 | 12/1982 | Turner et al. | 36/32 R |
| 4,392,312 | 7/1983 | Crowley et al. | 36/59 R |
| 4,393,604 | 7/1983 | Crowley | 36/59 R |
| 4,402,146 | 9/1983 | Parracho et al. | 36/32 R |

FOREIGN PATENT DOCUMENTS

| | | | |
|---|---|---|---|
| 2618655 | 11/1977 | Fed. Rep. of Germany | 36/59 R |
| 3025928 | 2/1982 | Fed. Rep. of Germany | 36/129 |

*Primary Examiner*—James Kee Chi
*Attorney, Agent, or Firm*—Robert T. Dunn

[57] ABSTRACT

An athletic shoe for use on artificial turf has an outer ground sole with cleats that project perpendicular from the surface of the sole, each cleat having a channel on one side extending to the projecting end of the cleat, the cleats being arranged on the sole so that the channel side of each cleat faces opposite to the most likely direction of force on the end of the cleat with respect to the sole during normal athletic activity of the wearer on artificial turf, whereas the side of the cleat opposite the channel is tapered so that the artificial turf fibers in the path of the cleat as it moves against and parallel to the artifical turf are gathered in the channel and the cleat slides along a gathered bunch of such turf fibers, bears upon the bunch of fibers so gathered and wipes the fibers of moisture in case they are wet; thereby providing a dry contact between the end of the cleat and the gathered bunch of fibers and so insures relatively high friction between the cleat and the turf fibers even when the turf is wet, whereas the cleat slides easily along the turf in the direction of the taper.

24 Claims, 17 Drawing Figures

FIG A
PRIOR ART

FIG B
PRIOR ART

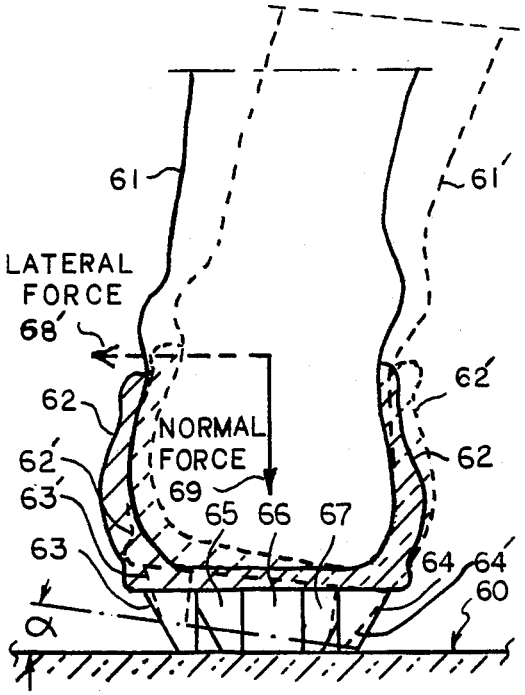
FIG 6
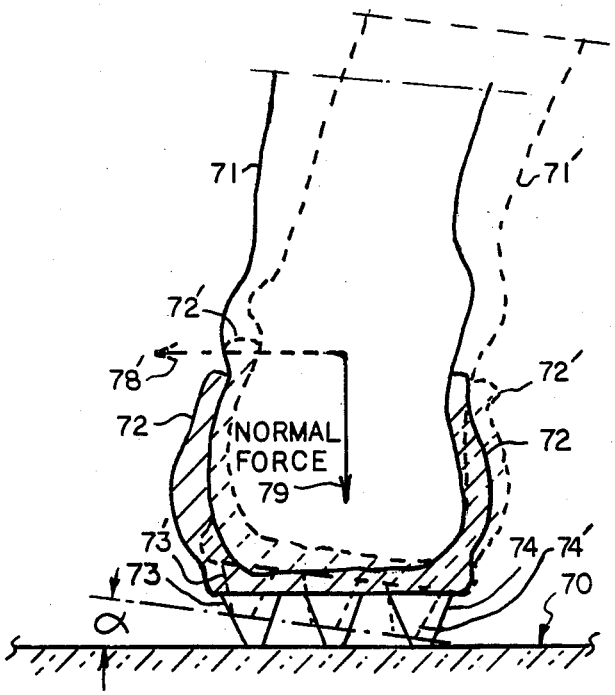
FIG C
PRIOR ART
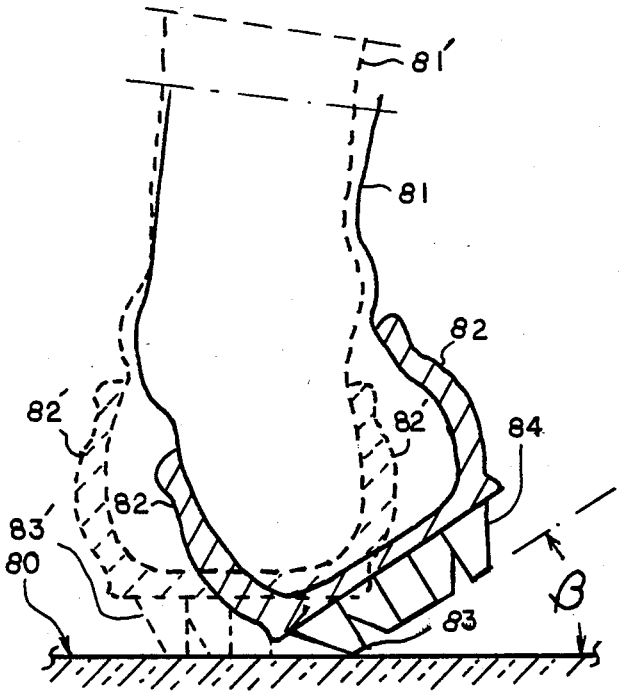
FIG 7
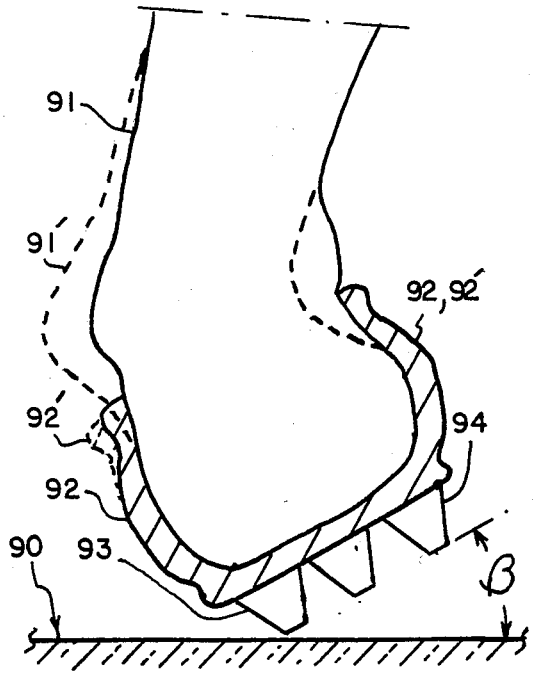
FIG D
PRIOR ART

ATHLETIC SHOE CLEATS FOR ARTIFICIAL TURF

BACKGROUND OF THE INVENTION

This invention relates to athletic shoes with cleated outer soles and more particularly to such athletic shoes for wear on synthetic or artificial turf of the kind that is surfaced with tufts of fibers that are locked to the surface of the turf and are generally upstanding from that surface in simulation of grass.

The introduction of synthetic or artificial turf such as Astroturf as a playing surface for football, soccer, baseball and other sports has been a benefit to the play of such games, but is clearly not the same and has different properties than a natural grass field that is properly conditioned with moist soil. On natural grass fields, the well-known conical cleat used on football and soccer shoes penetrates the grass surface into the soil and the lateral forces exerted on the hole in the soil caused by the penetrating cleat are contained; and, as a result, the player propells himself in the direction he intends without slipping. The resistance of slightly moist soil bound together by the grass roots and the blades of grass projecting upwards a few inches provides a sure footing for the player wearing such conical cleats, because the cleats can penetrate the blades of grass into the roots and soil. If the grass playing field is excessively wet, the soil becomes muddy and the lateral resistance of the soil to the penetrating cleat is not sufficient and the player slips. On the other hand, if the soil is excessively dry, it becomes hard and the cleat cannot penetrate and traction is poor.

Such conical cleats suitable on grass are not suitable on artificial turf, because the artificial turf cannot be penetrated. The cleated outer soles that have been developed in the past for play on artificial turf that has tufts of fibers on the surface as a simulation of grass, are usually molded as an integral part of the shoe sole. These include soles with many small conical cleats, each usually smaller than the cleats used on grass. The arrangements of the small conical cleats on the sole vary and some even offer soles with cleats of different sizes. The acceptance of any specific design depends largely on the opinion of the players. Generally, these cleated outer soles are adequate on a dry artifical turf field, but they are not satisfactory when the field is wet. Other cleat geometries such as square, triangular, star, etc. have the same problem on a wet field, in varying degrees.

Since the cleats of athletic shoes do not penetrate the surface of the artificial turf, traction depends upon the friction between the end of the cleat and the tufts of fibers on the surface. When the fibers are wet, they are, in effect, lubricated and the end of the cleat rides on the film of water on the individual fibers and so the cleat slips off. It is an object of the present invention to provide a cleat design and an arrangement of cleats on the outer sole of an athletic shoe that affords greater traction to the wearer on an artificial turf surface of tufted fibers even when the fibers are wet.

It is another object to provide an improved cleated outer sole for an athletic shoe that enables the wearer to have the necessary traction with a tufted fiber artificial turf when the wearer intentionally accellerates in any direction in normal athletic activity.

It is another object to provide such an outer sole that has substantially less traction with the turf when the wearer's foot is so positioned that high traction would be likely to result in injury.

It is another object to provide an improved cleated outer sole for a football shoe for use on artificial turf having tufted fibers on the surface thereof.

It is another object to provide an improved cleated outer sole for a baseball shoe for use on artificial turf having tufted fibers on the surface thereof.

It is another object to provide an improved cleated outer sole for a shoe for any running sport for use on artificial turf having tufted fibers on the surface thereof.

SUMMARY OF THE INVENTION

In a preferred embodiment of the present invention, the cleated outer sole of an athletic shoe is made in a unitary, molded piece consisting of a toe area, a ball area, an arch area and a heel area and an arrangement of cleats in at least the toe, ball and heel areas. The cleats are characterized in that they project perpendicular from the plane of the outer sole and each cleat has a channel or groove on one side that extends to the end of the cleat and the cleats are oriented so that the channel side of each cleat faces opposite to the most likely direction of force on the end of the cleat with respect to the plane of the sole during all usual actions of the player on artificial turf. As a consequence, each cleat tends to gather at the channel a bunch of the tufts of fibers as the cleat forceably contacts and slides over the surface and the gathered bunch of fibers are pressed between the end of the cleat and the surface of the turf creating relatively high friction between the cleat and the fibers and so providing good traction to the player.

If it should happen that the artificial turf fibers are wet, then the action of gathering them at the cleat channel as the cleat slides on the surface, tends to wipe the fibers dry and so the friction between the end of the cleat and the fibers is as between the cleat and dry fibers and the loss of friction and traction when the field is wet is avoided.

Other objects, features and advantages of the present invention will be apparent in view of the following description of embodiments of the invention which represent the best known uses of the invention. The invention accordingly comprises the elements and combinations of elements, features of construction and arrangements of parts which are exemplified in the structures herein described and in the scope of the appended claims.

The several embodiments of the invention are described in the accompanying drawings.

DESCRIPTION OF THE DRAWINGS

FIGS. A and B are plan and edge views of a conventional conical cleat as it plays through the tufted fibers on the surface of an artificial turf and is intended to illustrate the limitations of the conventional conical cleat;

FIGS. C and D are rear views of the wearer's left foot wearing a shoe with conventional conical cleats showing the movement and forces attending a normal intentional acceleration maneuver to the right and the same maneuver interrupted by a hit by another player coming from the right resulting in a situation where high traction with the turf is likely to cause injury, respectively;

FIGS. 6 and 7 are views of the wearer's left foot wearing a shoe with cleats according to the present invention showing the movement and forces attending a normal intentional acceleration maneuver to the right and the same maneuver interrupted by a hit by another player coming from the right resulting in a situation where high traction with the turf is less likely to cause injury than where the cleats are conventional conical cleats (to be compared with FIGS. C and D), respectively;

DESCRIPTIONS OF EMBODIMENTS OF THE INVENTION

Figure 1:
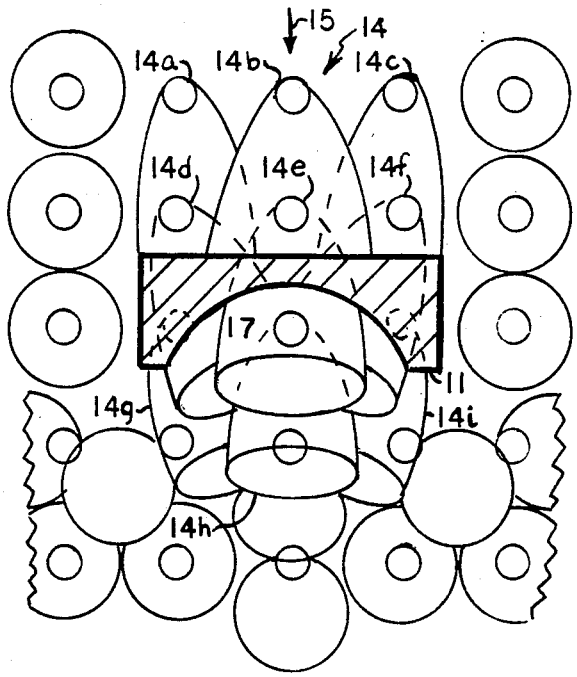
FIGS. 1 and 2 (to be compared with FIGS. A and B) are plan and lateral views of a cleat according to the present invention as it plays across the same artificial turf showing the action of the channel in the cleat to gather and ride on a bunch of tufts of fibers.

An athletic shoe incorporating all features of the present invention has an outer sole that has all of the following:

(1) The cleats and outer soles are made of a flexible elastomer with a dull surface such as natural rubber, in a configuration that allows concentrating of vertical force components and a broad face of the cleat opposing the lateral resistances of the artificial turf.

(2) When the tufted fibers on the surface of the artificial turf are wet (water is a lubricant), the cleats provide a "windshield wiper" effect to dry the fibers and provide a "grabbing" area where the cleat contacts the fibers. A relatively sharp edge of the cleat at right angles to the lateral forces on the shoe that contacts a bunch of the tufts of fibers produces the "windshield wiper" effect.

(3) The cleat must not penetrate the artificial turf surface, because that would damage the surface and cause a "cleat lock" requiring the player to lift his foot vertically to free his foot from the turf.

(4) Since the cleat edge must wipe the wet fibers of water in order to provide a friction surface between the cleat and fibers, the cleat must gather a bunch of the tufts of fibers and remain in contact with the bunch for a sufficient brief interval to wipe the water from the surface of the bunch of fibers so that it can make dry contact; it must not merely spread the tufts of fibers as the conventional conical cleat does.

(5) The non-functional parts of the cleat (i.e., those parts not at right angles to the forces resisting slip) should be tapered to allow the effective portions of the cleat to reach as close to the root of the fibers as possible.

(6) Cleat strength can be insured by tapering the cleat from the effective end to a relatively wide base where it meets the plane of the outer sole. Tapering also insures that when the cleat penetrates a grass surface or mud or snow, it can be withdrawn easily and does not become caught by suction.

(7) The distribution of the cleats on the outer sole for static conditions should be such that the player can stand flat footed and his weight will be distributed over a rounded triangular area defined by the heel bone, the small toe joint and the large toe joint. This constitutes the normal force which acts with the coefficient of friction on the entire sole surface to produce stability.

(8) The cleat distribution and orientation for dynamic conditions must take into account weight shifts to the portion of the foot bone structure and the shoe outer sole in the direction of the players motion. For example, in the case of the propelling foot, the forces on the cleat are in the direction of the acceleration of motion and as the propelling foot begins losing friction with the surface (as it lifts from the surface), a portion of the sole perimeter of the propelling foot still in contact with the surface must provide a higher amount of friction with the surface and still support the weight of the player plus the vertical force he may be inserting on the surface to propels his body upward, and so it is necessary that a small portion of the sole (the portion still in contact with the surface) be capable of providing sufficient friction to oppose the force delivered by the player as he accelerates. This means that the forward portion of the sole must provide resistance against slipping backwards, the back of the heel and the back of the ball area must provide resistance against slipping foreward, left side of the sole must provides resistance against slipping to the right, the right side provides resistance against slipping to the left and slipping in all directions inbetween those should be resisted by at least some of the cleats that are in forceable contact with the turf as the time.

According to one embodiment of the present invention, all of the above features are realized with a cleat that is designed to produce effective friction resistance with the artificial turf, principally in one direction, and that direction for each cleat is determined by the geometry of the cleat. For a shoe equipped with such cleats, friction resistance in different directions is provided by the distribution and the orientation of the cleats on the outer sole in consideration of the way the player's foot contacts the surface during the usual running maneuvers. For example, according to the above, the cleats on the left side of the sole are oriented with their geometry such that they offer resistance against slipping to the right and cleats on the right side of the sole are oriented with their geometry such that they offer resistance against slipping to the left, and so forth. Thus, the geometry of the cleat, the position of the cleat on the sole and the orientation of the cleat geometry depending upon the cleat position on the sole, in consideration of the player's dynamic maneuvers are all factors in bringing about and accomplishing the above described features and performances.

According to another embodiment, the geometry of each cleat is such that is has two different directions of high resistance to slipping. However, that cleat is subject to a compromise inasmuch as its resistance in each of the two different directions is not as effective as the resistance of a cleat having geometry that resists in only one direction. This geometry is intended to reduce the number of cleats on a given area of the sole, particularly where there is likely to be required high friction (traction) in two different directions each at a different time, such as under the big toe.

Turning first to FIGS. A and B, there is illustrated the conventional conical cleat 1 on the outer sole 2 of, for example, a football shoe, as that cleat engages the tufts of plastic fibers that are attached to the surface of artificial turf. FIGS. A and B are intended to illustrate how this conventional cleat forcibly contacts the tufts of fibers by the bottom of the cleat as the cleat moves across the surface in the direction of arrow 5 and so in the lateral view shown in FIG. B, the cleat 1 is moving toward the viewer. In FIG. A only an outline of the bottom end (print) 8 of the cleat is shown (cross-hatched). It should be noted that in this Figure and other figures that shown the tufts of fibers, that each tuft is attached to the turf at one of the small thin line circles regularly spaced in a matrix, while the free end of a tuft is represented by a larger thin line circle or ellipse depending upon whether the tuft is distributed by the cleat. The tufts outlined in heavy line are being ridden over by the cleat at the moment and the + indicates the approximate center of the free end of the tuft. It should be noted that in reality, each tuft may include twenty or more fibers and the individual fibers are often ribbon shaped.

With the conventional conical cleat, the circular (convex) surface of the cleat tends to push the tufts of fibers out of its way and at any given moment, it rides on only relatively few tufts of fibers and so the friction forces between the bottom of the cleat and the tufts of fibers is accordingly limited. In this illustration, the cleat is moving centrally on a line of tufts at the moment and so the tufts along that line, such as tufts 4*a* to 4*d* may not be pushed aside and the cleat may ride over them. Other tufts such as 4*e* and 4*f* in the adjacent line of tufts are pushed out of the way by the convex outer surface of the cleat.

Figure 2:
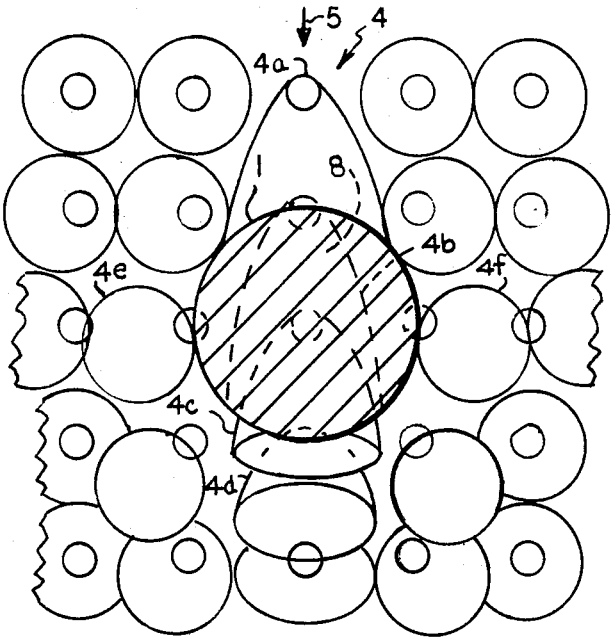
Figure 2:
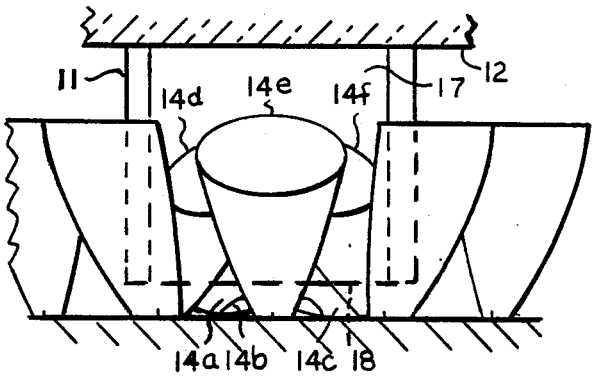

A cleat having geometry according to the present invention is illustrated in FIGS. 1 and 2. In FIG. 1, the end of the cleat 11 that bears against the fibers is shown bearing against a bunch of several tufts of fibers that are gathered under the cleat as it moves across the artificial turf in the direction of arrow 15. The bunch outlined in heavy line may include all tufts of fibers spaned by the concave recess 17 which extends along one side of the cleat from the plane of the outer sole 12 from which the cleat projects, to the contacting end 18 of the cleat. The movement of the cleat gathers together a bunch of tufts of fibers in the path of the concave recess and the cleat rides over this bunch and, as each tuft is released from the bunch when the cleat rides clear of it, another tuft is forced into the bunch. This action is illustrated in FIGS. 1 which shows the end (print) 18 of the cleat 11 (cross-hatched) riding on the nine tufts of fibers. The tufts of fibers are denoted generally 14 and the tufts in the bundle that is being rid over at the instant, as shown in FIG. 1, are outlined in heavy line and include tufts 14*a* through 14*i*. This action is also shown in FIG. 2 which is a lateral view looking at the concave recess of the cleat as the cleat moves toward the viewer.

Other prior cleat geometries such as square, triangular, star or ribbed may be less convex that the conical cleat, but do not have the distinctly concave side as in the present invention and so do not provide high resistance to slipping in one direction and low resistance to slipping in the opposite direction. Those other geometries do not have the unidirectional design of the present invention and are essentially omnidirectional. They intrinsically have a larger base area for the same size wiping edge, thereby reducing the penetration of the cleat into the fibers and reducing the concentration of forces at the effective edge (end) of the cleat. None of those geometries include a shallow taper opposite the side that provides high resistance to slipping.

The tufts of fibers denoted generally 4 in FIGS. A and B and denoted 14 in FIGS. 1 and 2, are made up of fibers that are tufted, knitted or woven into backing material on the artificial turf. The fibers are upstanding and usually ribbon-like in cross section shape and of a size to approximate the size of natural grass. The fibers have a suitable denier which may, for example, range from 225 to 900 denier and the width to thickness cross section of each fiber is on the order of 5. The fibers are locked into a backing material on the surface which may be a woven material made of suitable thermoplastic such as for example polyesthers, polypropylene, or nylon fibers, or combinations thereof. This tuft structure consisting of the backing material with the tufts of fibers on the surface is bonded to an underlayment layer with a suitable adhesive. None of that structure is disclosed herein, because it is not the subject of the present invention. Clearly, the tufts of fibers on the surface of the artificial turf are significant to the action of the cleats which are the subject of the present invention. That action of the cleat on the fibers as it is described herein, is essentially the same whether the fibers were flat ribbon-like or round cylinder-like fibers. Inasmuch as the usual or more common artificial turf with a grass-like fiber layer covering is common and found in Astroturf, ribbon-like fibers of the sort used in those turf structures are described herein.

Figure 3:
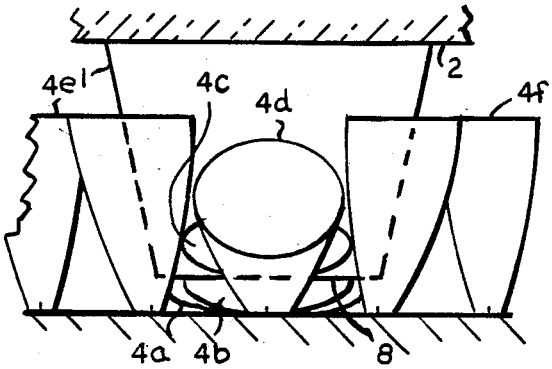
FIGS. 3 and 4 are top sectional and side sectional views of the cleat demonstrated in FIGS. 1 and 2 that incorporate features of the present invention and superimposed thereon is the outline of an equivalent conventional cleat for comparison.
Figure 3:
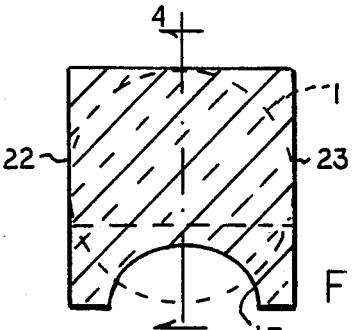
Figure 4:
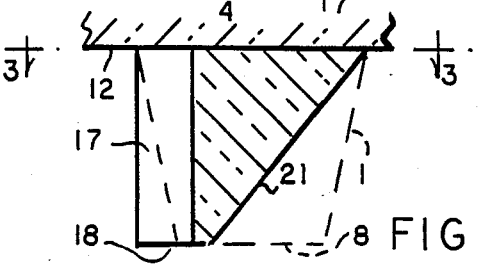

FIGS. 3 and 4 are cross section views of the cleat shown in FIGS. 1 and 2 taken as shown. Clearly, the cleat tapers considerably at side 21 from the plane of the outer sole 12 to the end 18 of the cleat. This taper strengthens the cleat in the direction of force on the cleat that tends to tear it from the sole. That direction of force in FIG. 1 is opposite to the arrow 15. The taper, in addition, gives the cleat a wedge shape so that when thrust into mud, soft earth or other semi-fluid surface, the cleat withdraws readily and does not create a suction lock. This is important on natural surfaces where the cleat according to the present invention is superior to conventional cleats designed primarily for penetration. Clearly, the taper strengthens the cleat attachment to the sole and forms a small high pressure area 18 at the contacting end of the cleat.

Another important feature of the taper on the side of the cleat opposite the concave recess 17 is to insure that the cleat has little on no traction with the turf when the cleat moves against the turf in the direction opposite the concave recess. For example, when the wearers foot is positioned so that the cleat bears against the turf while lateral forces on the wearer would tend to cause injury if the cleat would not slide easily across the turf. FIGS. 7 and D illustrate such a maneuver and are intended to demonstrate the advantage of the applicant's cleat that has an extreme taper 21 on the opposite side from the high traction side 17 over the conventional conical cleat of equivalent size. An outline in faint broken line of the equivalent conical cleat is shown superimposed on FIGS. 3 and 4 for comparison with the applicant's cleat. Clearly, there is no way that the equivalent conventional conical cleat can taper as extreme as the tapered side 21 of the applicant's cleat.

The cleat shown in FIGS. 1 through 4 is not tapered as viewed in FIG. 2, because a taper from that view is not required and would tend only to push tufts of fibers out of the way without making any friction contact with them.

Another purpose of not tapering or rounding the sides 22 and 23 of the cleat so as to provide convex side surfaces, is that a convex surface as in the conventional conical cleat tends to push tufts of fibers out of the way of the cleat. In other words, it does the opposite of the concave surface that is incorporated in the cleats of the present invention. A cleat cannot ride over and bear against a tuft of fiber if the cleat pushes the tuft to the side. It can ride over only the tufts of fibers that are not pushed to the side and that remain in the path of the cleat. Hence, the straight sides 22 and 23 of the cleat as shown in FIGS. 1 through 4 are intentional in case the cleat moves in the direction faced by those surfaces and some traction is required. On the other hand, the sides 22 and 23 and the extreme tapered side 21 may all be rounded (convex) to minimize traction in the directions of those faces (see embodiment of FIG. 12).

Figure 11:
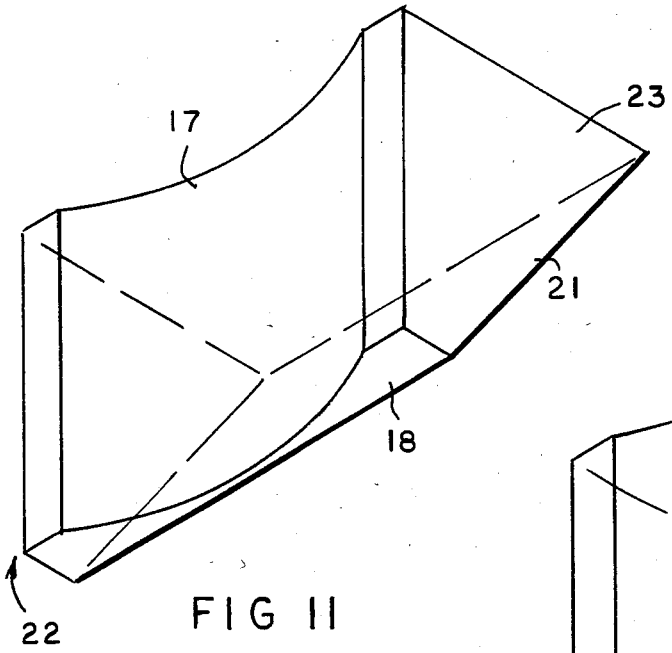
FIGS. 11 12, and 13 are all three-quarter views looking toward the bottom of the outer sole from the end of the cleat of three forms of cleats incorporating features of the present invention.

A three-quarter view of the cleat shown in FIGS. 1 through 4 is shown in FIG. 11. The prominent features of the cleat are clearly the concave recess 17 which faces the direction of usual movement of the cleat when it must make a high friction contact with the turf and the extremely tapered side 21 opposite the recess and so the cleat can be said to be a highly unidirectional traction device.

Figure 12:
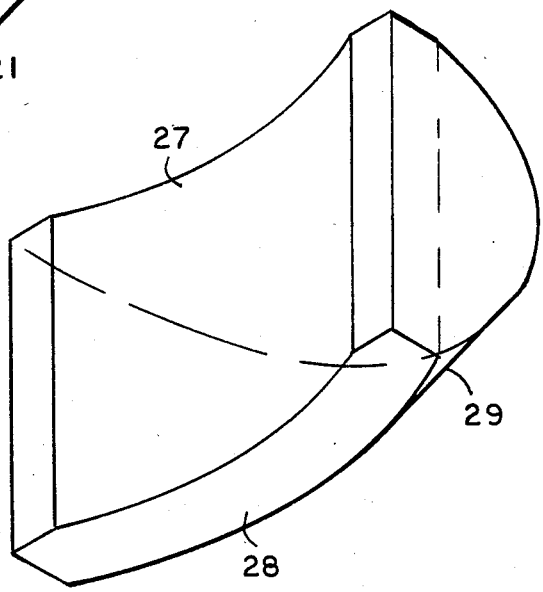

Another embodiment of this cleat is shown in FIG. 12 which offers essentially the same concave surface, denoted 27, a similar contacting end 28 and an extremely tapered side 29 opposite the concave surface side. However, the other sides 31 and 32 and the tapered side of the cleat are rounded and sides 22 and 23 are slightly tapered, all of which helps to insure a ready release from suction when the cleat is thrust into semi-fluid mud or snow. In addition, this embodiment provides high traction in only one direction and minimum traction in all other directions. An advantage, from the standpoint of safety and avoiding injury, of minimum (or no) traction particularly in the direction opposite the high traction direction is demonstrated herein with reference to FIGS. 6 and 7.

Figure 13:
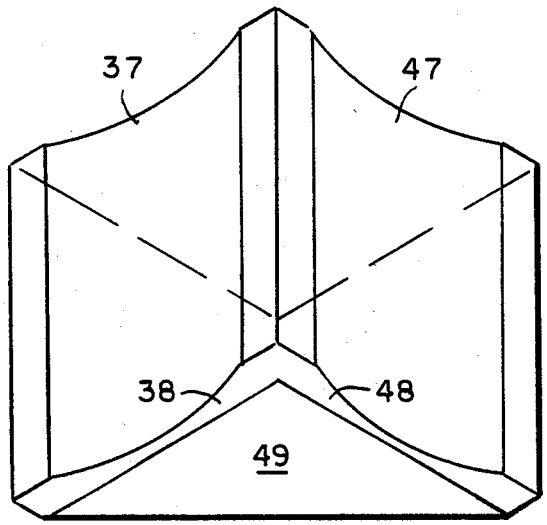

Another embodiment is illustrated in FIG. 13 where the cleat has two concave recessed surfaces so that the cleat is capable of gathering tufts of fibers in a bunch, as already described with reference to FIGS. 1 through 4, as the cleat moves in each of those two directions across the turf. In this embodiment, the concave recess surface 37 extends from the base of the cleat where it projects from the sole to the end and defines a contacting end 38 of the cleat that contacts the turf. Similarly, another face includes a concave recess 47 that extends from the base of the cleat to the end where it defines contact area 48. The flat end 49 of the cleat meets these ends of the channels 38 and 48 as beveled edges. In all other directions, this cleat offers low resistance to slipping and so it is a bidirectional cleat.

The dynamic performance of all of these embodiments of cleats according to the present invention is essentially the same as described with reference to FIGS. 1 and 2. The concave edge of the channel in each of these cleats, where it meets the end of the cleat, spans a bunch of tufts of fibers and "bunches" them together so that the cleat rides the bunch and friction arises between the edge of the cleat in contact with the bunch and so the cleat provides high traction with the turf. This action requires that the cleat move in the direction faced by the concave surface. Clearly, the dry friction forces between the applicant's cleat and the turf are greater than can be obtained with the conventional conical cleat, all other factors being equal.

Another advantage of the applicant's cleat over the conventional conical cleat arises when the turf is wet. Since water is a lubricant, a conventional conical cleat tends to slip off the tufts of fibers. It tends to slip off of the tufts, because it does not wipe the fibers dry. It is well known that high friction occurs between dry surfaces and if there is a layer of water between two surfaces, then the friction will be low. An example of the occurrance of this phenomena is when an automobile tire contacts a wet pavement. The tire will slip unless the tire treads force water from the surface so that the treads can for an instant contact dry surface. When that occurs, friction between the tire and the surface is maintained and traction is good. Essentially the same thing occurs with the cleat according to the present invention. By "bunching" the tufts of fibers together so that the end of the cleat can ride on the bunch for a sufficient interval to wipe the water from the fibers, the cleat rides on a bunch of tufts of dry fibers and so there is "dry friction" between the cleat and fibers even on the wet artificial turf.

Figure 5:
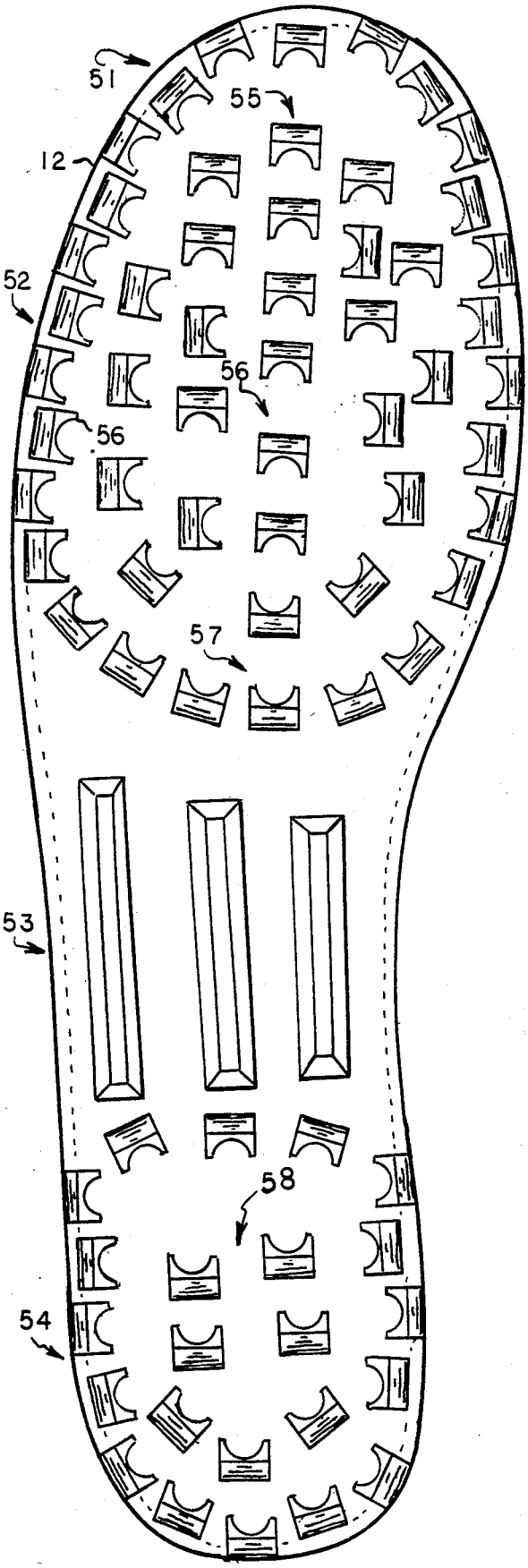
FIG. 5 is a bottom view of a unitary outer sole for, for example, a football or soccer shoe, equipped with cleats according to an embodiment of the present invention.

FIG. 5 is a bottom view of an outer sole of an athletic shoe equipped with cleats according to the present invention. This design is particularly good for football, soccer and other field sports where the player must accelerate, stop and turn and where there is contact between players and so a player may be impacted suddenly by a force from any direction. The areas of this outer sole 12 are the toe area 51, the ball area 52, the arch area 53, and the heel area 54. The entire outer sole and the cleats are molded as a unitary piece of a suitable plastic such as a normal elastomer rubber in the durometer range of 60 to 70. Around the periphery of the toe and ball areas 51 and 52, the concave face of the cleats such as face 17 of cleat 11 is directed inwards toward the center of the ball area, whereas cleats along the center of the toe area at 55 and the ball area at 56 are oriented with their concave faces directed toward the heel except on the edge of the ball area at 57, immediately adjacent the arch area 53, where the central cleats have their concave faces toward the toe. On each side of center in the toe and ball areas 51 and 52, respectively, the cleats to the left of center are directed to the right and to the right of center are directed to the left just as are also the peripheral cleats.

In the heel area 54, the cleats along the periphery are all directed toward the center of the heel, whereas those inside the periphery at 58 are all generally directed toward the toe.

The orientations of the cleats at the toe, ball and heel areas in FIG. 5 are in accordance with the most likely direction of force each cleat is calculated to exert on the turf during normal intentional play maneuvers in a game such as football or soccer. Those maneuvers include the following:

(1) when the player accelerates forward, cleats adjacent the toe and the forward part of the ball area are the most effective and so the predominant number of those should face (the concave side of the cleat) toward the heel;

(2) when the player accelerates to the left with his right foot, the cleats along the left side of the right foot are the most effective and so they should face toward the players right and this is the case along the toe area, the ball area and the heel area. Similarly, when the player accelerates with his right foot to the right, the cleats along the right side of his right foot are the most effective and so they should be faced toward his left;

(3) when the player decelerates his forward motion, the cleats along the rear part of the ball area and the cleats along the rear part of the heel area are most effective and so they should face forward.

Clearly, in all field games where the player must accelerate forward, left or right and decelerate, this general orientation of the cleats according to the present invention is much the same and so the same orientation may be used for all such sports. Clearly, modifications may be made in the size of the cleats and larger cleats may require that the material of which the cleats are made to be more rigid than the material of which the smaller cleats are made. For example, a higher durometer rubber may be used to form the outer sole and the cleats may be formed of hard plastic such as nylon and separately attached to the sole.

The function of the cleat in normal intentional dynamic action such as when the wearer pushes off with his left foot to accelerate to this right, is illustrated by FIG. 6. The action begins from the position of the shoed foot normal to the turf 60. The solid line 61 in FIG. 6 represents the left foot viewed from the rear and the solid line in cross section 62 is the shoe on that foot. The cleats arranged like the cleats on the football or soccer shoe sole in FIG. 5 include heel peripheral cleats 63 and 64 on the left and right side, respectively, of the heel area of the sole and several cleats 65, 66 and 67 between those peripheral cleats.

The broken line 61' in FIG. 6 shows the position of the foot as the wearer pushes off to his right. The force exerted by the left foot on the turf now has a lateral component 68' to the left as well as the normal force 69, accompanied by a shift of the wearer's body to the right. As a result, the foot tilts to the right as shown by line 61' and the shoe tilts with it as shown by the broken line outline 62' of the shoe and the cleats along the left periphery, like cleat 63' lift off the turf while those like 64' along the right periphery apply the total normal and lateral left acceleration force to the turf. The tilt of the shoe from the initial position (solid line) to the dynamic position (broken line) is represented by angle $\alpha$.

At the dynamic position in FIG. 6, the right side peripheral cleats like 64' carry just about the total normal and left lateral force of the foot against the turf at the contacting end 18 (see FIGS. 1 to 4) of the cleat and the cleat concave recess face 17 is essentially perpendicular to the turf and so the cleat exerts a high friction wiping action on the turf tufts of fibers as described above with reference to FIGS. 1 to 4.

The action demonstrated in FIG. 6 with cleats according to the present invention can be compared with the same action wearing conventional conical cleats as shown in FIG. C. In that Figure, the foot 71 and shoe 72 are initially represented by the solid line and in carrying out the dynamic action reach an equivalent position represented by the broken line, with the foot at 71' and the shoe at 72'.

The conical cleats are figures of revolution and exhibit the same force in all lateral directions (they are omnidirectional traction devices) and so they have no lateral directivity and are not differently oriented on each side of the shoe than another. However, for identification, consider those on the left side as represented by cleat 73 and on the right side by cleat 74.

In FIG. C, the action position of the foot, shoe and cleats is shown by the broken lines. The foot at 71' has titled to the right as the wearer pushes off to the right, exerting a lateral force component 78' to the left in addition to the normal force 79 on the turf 70 and the shoe tilts to the angle $\alpha$, lifting cleats 73 from the turf and so all of the normal and lateral forces are applied to the turf by cleats like 74'. Since the bottom of cleat 74' is tilted at the angle $\alpha$, only the right edge of that cleat is in hard contact with the turf; the left edge is slightly lifted. Hence, in this dynamic action, conical cleats like 74' have no more ability to contact and wipe tufts of turf fibers than as illustrated herein and described with respect to FIGS. A and B.

Turning next to FIG. 7, there is shown a view similar to the view in FIG. 6 of the left foot and shoe equipped with cleats according to the present invention and described particularly with respect to FIGS. 1 to 4 and 5. The action depicted in FIG. 7 shows the left foot while the wearer is pushing off to the right and is hit from the right (as in football) by another player. As a result, the left foot tends to remain in contact with the turf and rotates from a slight tilt at angle $\alpha$ to the right (as shown by the broken lines in FIG. 6) to a greater tilt at angle $\beta$ to the left as in FIG. 7, because the impact of the hit is so great. That dynamic condition, following the hit, is represented by the solid line 81 outline of the foot, solid line 82 outline of the shoe and left and right side peripheral heel cleats 83 and 84.

From the dynamic condition shown by the solid lines in FIG. 7, further turning of the ankle may seriously injure the ankle. This condition can be alleviated by straightening the angle which the wearer will instinctively do; provided the straightening action is not prevented by the left side cleat 83 contact with the turf. The applicant's cleats according to the present invention have a substantially greater taper on the side 21 opposite the concave recess 17 (see FIGS. 3 and 4) than an equivalent (in size) conical cleat giving the applicant's cleat far less traction with the turf in the direction faced by the taper than the equivalent conical cleat. Hence, the condition illustrated by the solid line in FIG. 7 is more easily alleviated and the wearer can more easily straighten the ankle to the less dangerous position shown by the broken lines in FIG. 7. than with conventional conical cleats, or, for that matter, with any essentially omnidirectional cleat.

FIG. D shows the same dynamic action as depicted in FIG. 7, but with conventional conical cleats. It depicts the same initial dynamic condition as in FIG. 7, represented by the solid line outline of the left ankle 91, shoe 92 and left and right side conical cleats 93 and 94, after the wearer has pushed off to the right and is hit from the right. From this condition the wearer often cannot straighten his ankle, because the left side cleats like 93 cannot slide readily on the turf, and, in fact, may make a greater friction or penetration contact with the turf than when normal to the turf. As a consequence, the ankle turns more as represented by the broken line outline 91' and injury is likely.

Figure 8:
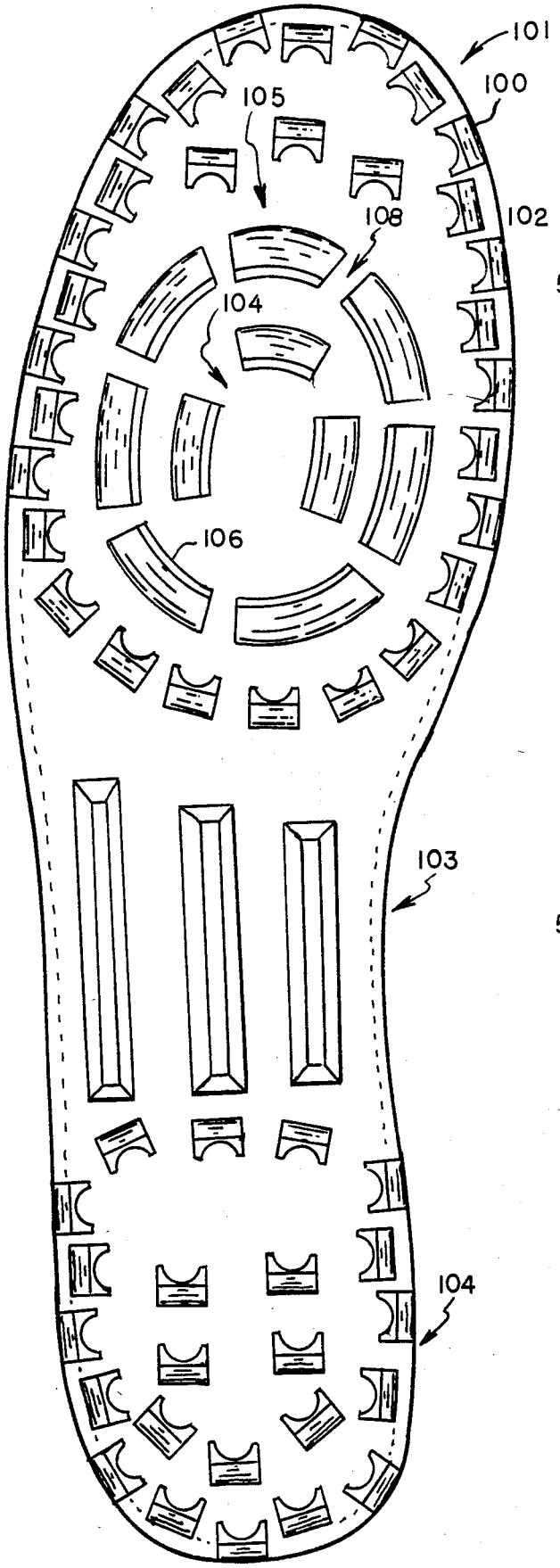
FIG. 8 is a bottom view of a unitary outer sole for, for example a baseball shoe, equipped with cleats according to an embodiment of the present invention.

A particular modification for a baseball shoe sole 100 is illustrated in FIG. 8. Here the cleat size and arrangement at the toe area 101, at the periphery of the ball area 102 and at the arch area 103 and heel area 104 are the same as in FIG. 5. However, within the ball area at 105 are two sets of different shaped cleats which define concentric circles. This enables the baseball player, particularly when at bat, to turn on the ball of his foot as he swings the bat. It should be noticed that the peripheral cleats around the toe and the ball area do not substantially inhibit this kind of turning, because they are not directed against it and because the batter puts more load on the ball of his foot at the center thereof than at the periphery. On the other hand, the inner cleats in the toe and ball area for the football shoe configuration shown in FIG. 5 would tend to inhibit the sort of turning required of a batter in baseball. And so, the baseball shoe includes a special shaped cleat like cleat 106 in the larger circle and cleat 107 in the smaller circle in the ball area 105. One of these cleats, cleat 106, is shown in greater detail in FIGS. 9 and 10 is several times wider than it is deep and defines a portion of the circle so that when several of them are arranged in a circle, they define the circle.

Figure 9:
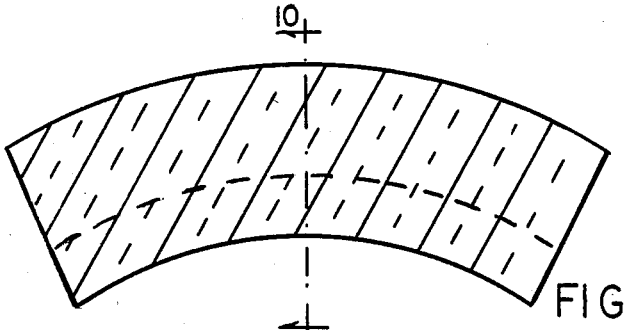
FIGS. 9 and 10 are top and side sectional views of a typical one of the center cleats at the ball area of the sole of the outer sole of the baseball shoe shown in FIG. 8.
Figure 10:
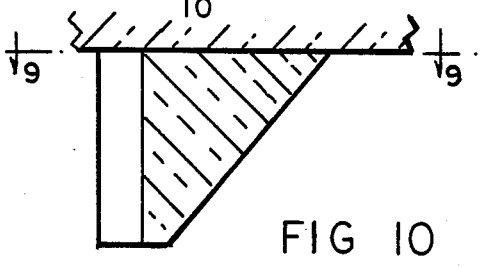

As shown in FIG. 9, the outer circle 108 of cleats at the ball area 105 consists of seven cleats like 106 and the inner circle 109 consists of three cleats like 106. All of the cleats like 106 have a concave face and that face is directed in all cases for traction on the artificial turf when the player accelerates forward, left, right, or decelerates, and so, in addition, the batter's pivoting action described is not impeded. The concave faces of these cleats, performed just as already described with regard to the smaller cleats in contacting the tufts of fibers on the surface of artificial turf for sufficient traction and produce the wiping effect in case of wet turf to maintain a dry friction contact.

In view of the above, it will be seen that the several objects of the present invention are achieved and the intended features are incorporated in the embodiments. It is to be understood that the invention is not limited in its application to the details of construction and arrangements illustrated in the embodiments, since the invention is capable of other embodiments and of being practiced or carried out in other ways. Also, it is to be understood that the terminology employed herein is for the purpose of description and not of limitation. Since changes could be made in the construction described herein without departing from the scope of the invention, it is intended that all matter contained in the descriptions of embodiments herein or shown in the accompanying drawings shall be interpreted as illustrative and not in a limiting sense and it is also intended that the appended claims shall cover all such equivalent variations as come within the spirit and scope of the invention.

What is claimed is:

1. In an athletic shoe for use on artificial turf that has a surface of turf fibers, a ground sole with a plurality of cleats that project substantially perpendicular from the surface of the sole, having the improvement comprising:

(a) each cleat has a channel on one side thereof extending substantially perpendicular to the surface of the sole to the end of the cleat, (b) the side of the cleat opposite said channel side being substantially tapered from the end of the cleat to the surface of the sole, (c) said channel side of each of said cleats facing the most likely direction of force that the end of the cleat in contact with the artificial turf exerts on the turf during normal intentional maneuvers of the wearer of the shoe, (d) whereby the artificial turf fibers in the path of the cleat when the cleat moves across the turf in said most likely direction are gathered in said channel and the end of the cleat bears against the fibers so gathered making relatively high friction contact therewith, (e) while the same cleat, when moving across the turf in the direction opposite said most likely direction makes relatively low friction contact therewith.

2. An athletic shoe as in claim 1 wherein the channel extends from the plane of the sole from which the cleat projects to the end of the cleat.

3. An athletic shoe as in claim 1 wherein the channel is defined by a concave recess in the cleat, the axis ofsaid concave recess being substantially perpendicular to the surface of the sole.

4. An athletic shoe as in claim 1 wherein the channel is formed by a concave surface that defines a portion of a cylinder of which the cylinder axis is parallel to the projecting length of the cleat.

5. An athletic shoe as in claim 4 wherein the said cylinder axis lies outside of the cleat.

6. An athletic shoe as in claim 1 wherein the tapered side of the cleat opposite said channel tapers significantly so that the cleat cross-section area at the plane of the sole is substantially greater than at the end of the cleat.

7. An athletic shoe as in claim 1 wherein the tapered side of the cleat opposite said channel tapers significantly so that the cleat cross-section area at the plane of the sole is substantially greater than at the end of the cleat, whereby the cleat attachment to the sole resists forces at the end of the cleat parallel to the surface of the sole against the channel side.

8. An athletic shoe as in claim 7 wherein the other sides of the cleat are essentially parallel to each other.

9. An athletic shoe as in claim 1 wherein a cleat has such channels on two sides, each facing a different likely direction of force of the cleat on the turf during normal intentional maneuvers of the wearer.

10. An athletic shoe as in claim 9 wherein said channels are on adjacent sides of the cleat.

11. An athletic shoe as in claim 4 wherein the tapered side of the cleat opposite said channel tapers significantly so that the cleat cross-section area at the plane of the sole is substantially greater than at the end of the cleat.

12. An athletic shoe as in claim 11 wherein the other sides of the cleat are essentially parallel to each other.

13. An athletic shoe as in claim 1 wherein some of said cleats are arranged on both the left and the right sides of the sole and said channel side of said cleats so arranged face toward the longitudinal center line of the sole.

14. An athletic shoe as in claim 1 wherein some of said cleats are arranged at the toe of the sole and said channel sides of said cleats so arranged face toward the heel of the sole.

15. An athletic shoe as in claim 1 wherein some of said cleats are arranged just forward of the arch area of the sole and said cleats so arranged face toward the toe of the sole.

16. An athletic shoe as in claim 1 wherein some of said cleats are arranged at the back of the heel of the sole and said channels of said cleats so arranged face toward the toe of the sole.

17. An athletic shoe as in claim 1 wherein some of said cleats are arranged just rearward of the arch of the sole and said channels of said cleats so arranged face toward the heel.

18. An athletic shoe as in claim 1 wherein some of said cleats are arranged in a first loop long the periphery of the sole forward of the arch and said channels of said cleats so arranged face toward the inside of the said first loop.

19. An athletic shoe as in claim 1 wherein some of said cleats are arranged in a second loop along the periphery of the heel of the sole and said channels of said cleats so arranged face toward the inside of said second loop.

20. An athletic shoe as in claim 17 wherein other of said cleats are arranged in a second loop along the periphery of the heel of the sole and said channels of said cleats so arranged face toward the inside of the said second loop.

21. An athletic shoe as in claim 20 wherein other of said cleats are arranged in said first loop and said channels of said cleats so arranged face toward the center of the sole, except that those cleats substantially at the center line of the sole face toward the heel or the toe.

22. In an athletic shoe for use on artificial turf having tufts of fiber that simulate grass on the surface thereof, a ground sole for the shoe with a plurality of cleats that project perpendicular from the surface of the sole, the improvement comprising, (a) each of said cleats having a channel on one side thereof extending substantially along the projecting length of the cleat to the end thereof and meeting substantially perpendicular thereto a flat surface at the end of the cleat, (b) the side of the cleat opposite said channel side being substantially tapered from the end of the cleat to the surface of the sole, (c) said channel side of each of said cleats facing the most likely direction of force that the end of the cleat in contact with the artificial turf exerts on the turf during normal intentional maneuvers of the wearer of the shoe, (d) whereby the artificial turf fibers immediately adjacent the cleat channel are gathered in the channel when the cleat contacts and slides over the fibers in said most likely direction, the said flat surface at the end of the cleat bears against the fibers so gathered in the channel wiping the fibers clean of moisture and thereby increasing the coefficient of friction between the said fibers and the cleat, (e) while the same cleat, when moving across the turf in the direction opposite said most likely direction makes relatively low friction contact therewith.

23. In an athletic shoe for use on artificial turf that has tufts of fibers that simulate grass on the surface of the turf, the shoe having a ground sole with a plurality of cleats that project substantially perpendicular from the surface of the sole and wherein a significant activity of the wearer includes pivoting on the ball of the wearer's foot as is done by the batter in baseball and the like, the improvement comprising:

(a) some of said cleats having a channel on one side thereof extending substantially the projecting length of the cleat, (b) the side of the cleat opposite said channel side being tapered from the end of the cleat to the surface of the sole, (c) said cleats with channels being arranged to define a circle at the ball of the wearer's foot, said circle being within said peripheral cleats, (d) whereby the wearer can readily pivot on the ball of his foot whether on said artificial turf, dirt, grass or other surface as required of a batter in baseball.

24. In an athletic shoe for use on artificial turf that has a surface of turf fibers, a ground sole with a plurality of cleats that project substantially perpendicular from the surface of the sole, having the improvement comprising:

(a) each having a channel on one side thereof extending substantially perpendicular to the surface of the sole and extending to the end of the cleat, (b) the channel side of each of said cleats facing opposite to the most likely direction of force on the end of the cleat with respect to the sole when the cleats contact the artificial turf while moving horizontal thereto during normal intentional maneuvers of the wearer of the shoe, (c) whereby the artificial turf fibers in the path of the cleat are gathered in the channel and the end of the cleat bears against the fibers so gathered.

* * * * *